United States Patent [19]

Bonnet

[11] Patent Number: 4,835,814

[45] Date of Patent: Jun. 6, 1989

[54] VACUUM CLEANER

[75] Inventor: Jacques Bonnet, Besancon, France

[73] Assignee: Rowenta-Werke GmbH, Offenbach am Main, Fed. Rep. of Germany

[21] Appl. No.: 135,669

[22] Filed: Dec. 21, 1987

[30] Foreign Application Priority Data

Dec. 22, 1986 [DE] Fed. Rep. of Germany ... 8634311[U]

[51] Int. Cl.[4] ..... A47L 9/28

[52] U.S. Cl. ..... 15/339

[58] Field of Search ..... 15/339, 412, 315

[56] References Cited

U.S. PATENT DOCUMENTS 2,121,396 6/1938 Dayton ..... 15/315 X
3,357,039 12/1967 Hayward ..... 15/314
4,688,292 8/1987 Schmiegel ..... 15/339 X
4,697,299 10/1987 Brinkhoff et al. ..... 15/339 X

FOREIGN PATENT DOCUMENTS 3044976 6/1982 German Democratic Rep. ... 15/339
3529133 2/1987 German Democratic Rep. ... 15/339

*Primary Examiner*—Chris K. Moore
*Attorney, Agent, or Firm*—Toren, McGeady & Associates

[57] ABSTRACT

A vacuum cleaner has a motor housing 1 and a suction unit 2 which comprises a suction nozzle 3 and a suction hose for communicating the nozzle with the housing. The suction unit has a hook-up device 4 which may be hooked on to a mounting 5 of the housing to operate a switch 6 provided in the housing and thereby switch off the vacuum cleaner.

5 Claims, 1 Drawing Sheet

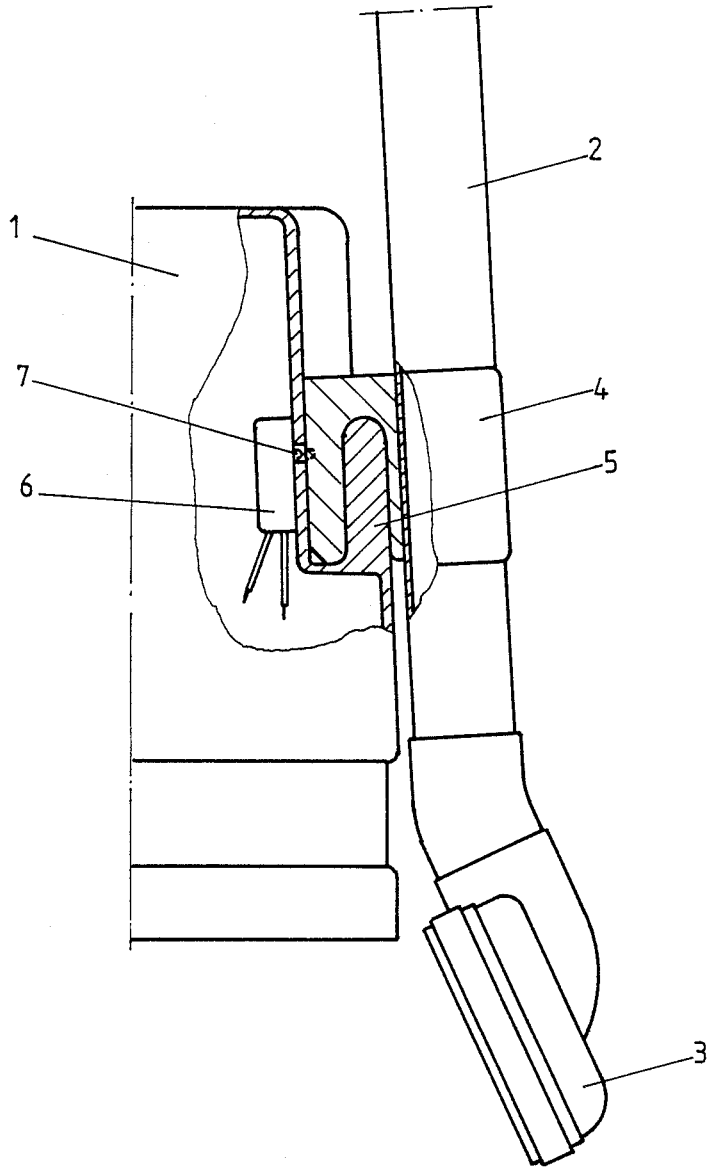
1
2
3
4
5
6
7

VACUUM CLEANER

BACKGROUND OF THE INVENTION

1. Field of the Invention

The invention relates to a vacuum cleaner having a main body and a suction unit which comprises a suction nozzle and a suction hose for communicating the nozzle with the main body.

2. Description of the Prior Art

In vacuum cleaners, particularly floor-type vacuum cleaners, the suction nozzle communicates via a suction hose with the motor housing so as to be spatially separated therefrom, thereby making the handling of the vacuum cleaner easier since the suction nozzle together with the hose is easier to move than the motor housing. It is also known to hook the suction unit onto the vacuum cleaner housing when the vacuum cleaner is being transported or is not in use. This has the advantage that the vacuum cleaner can easily be transported together with the suction unit mounted thereon but is still ready for operation by means of a handle. There is however the disadvantage that the appliance has to be switched on and off at the motor housing.

SUMMARY OF THE INVENTION

According to the invention there is provided a vacuum cleaner having a main body, a suction unit which comprises a suction nozzle and a suction hose for communicating the nozzle with the main body, mounting means on the suction unit for mounting the unit on the main body, and an electrical switch provided on the main body and arranged to be operated by the mounting means.

When the vacuuming process is interrupted, e.g. for the purpose of carrying the vacuum cleaner into another room or in order to break off for a short time to do something else, the suction unit is mounted on the main body using the mounting means. By so mounting the suction unit the electrical switch is operated to switch off the appliance. If the suction unit is removed from the main body in order to resume the vacuum cleaning operation, the appliance is automatically switched on again. There is consequently no need to operate a switch which may be provided separately on the main body each time the vacuum-cleaning operation is interrupted for a short time. Thus a vacuum cleaner may be rendered voltage-free by suitable means when the vacuuming process is interrupted without having separately to operate an electrical switch on the vacuum cleaner housing.

Preferably the mounting means comprises a hook device on the suction unit connectible to a mounting on the main body, the electrical switch being provided in the region of said mounting. The switch may be mounted inside a motor housing. Known switches such as touch switches, micro switches, sensor switches, magnetic switches or reed switches may be used.

BRIEF DESCRIPTION OF THE DRAWING

The drawing shows a partial view of the vacuum cleaner main body with the suction unit mounted thereon.

DETAILED DESCRIPTION OF THE INVENTION

A preferred embodiment of the invention will now be described wherein the main body of the vacuum cleaner includes a motor housing 1 on which the suction unit is mounted. The suction unit consists of a suction hose (not shown) with a handle, a suction tube 2, a suction nozzle 3 and a hook means 4 mounted with the suction tube 2. The hook means 4 is operably connected to a hook shaped mounting 5 provided on the housing 1. Inside the housing 1 an electrical switch 6 is provided. The switching button 7 of the switch 6 (dashed lines) protrudes through the housing wall in the region of the mounting 5. The switch 6 is actuated by means of the hook means 4 which, in the position shown, also the full line position of switching button 7, renders the vacuum cleaner motor voltage-free by means of the switching button 7 of the switch 6.

Modifications of the invention as disclosed herein both in its broad aspects and its preferred embodiment may be apparent to a person skilled in the art and it is intended that such modifications be encompassed within the scope of this disclosure.

I claim:

1. A vacuum cleaner including a main body, a suction tube and a suction nozzle including;

(a) a hook means adapted to support said nozzle mounted with said suction tube, (b) a hook shaped mount on said main body, (c) a switch in electrical communication with a motor of said vacuum cleaner including a depressible switch operating button mounted on one of said mount and said hook means, and (d) the other of said hook means and hook shaped mount depressing said switch operating button when said hook means engages with said hook shaped mount.

2. The vacuum cleaner of claim 1 wherein;

(a) said switch is fixedly mounted relative to said main body.

3. The vacuum cleaner of claim 2 wherein;

(a) said hook means engages said button upon insertion of said hook means into said hook shaped mount.

4. The vacuum cleaner of claim 3 wherein;

(a) said hook means is attached directly to said suction tube.

5. A vacuum cleaner including a main body, a suction tube and a suction nozzle including;

(a) a hook means adapted to support said nozzle mounted with said suction tube, (b) a mount on said main body, (c) a switch in electrical communication with a motor of said vacuum cleaner including an operating element extending from said mount, (d) said operating element contactable by said hook means when said hook means is inserted in said mount to thereby actuate said switch.

* * * * *